United States Patent [19]

Snavely

[11] 4,301,909

[45] Nov. 24, 1981

[54] VENDING APPARATUS

[76] Inventor: John D. Snavely, 1700 Herman Dr., #506, Houston, Tex. 77004

[21] Appl. No.: 60,416

[22] Filed: Jul. 25, 1979

[51] Int. Cl.[3] ..... G07F 11/48

[52] U.S. Cl. ..... 194/2; 194/10; 221/6; 221/123; 221/195

[58] Field of Search ..... 221/2, 6, 9, 13, 121, 221/123, 126, 127, 191, 195, 224; 194/1 N, 2, 10

[56] References Cited

U.S. PATENT DOCUMENTS

| | | | |
|---|---|---|---|
| 1,191,032 | 7/1916 | Pierre . | |
| 2,785,828 | 3/1957 | Patzer . | |
| 3,128,013 | 4/1964 | Holstein et al. . | |
| 3,144,113 | 8/1964 | Peterson . | |
| 3,194,432 | 7/1965 | Breitenstein et al. . | |
| 3,270,916 | 9/1966 | Lyman | 221/6 |
| 3,486,658 | 12/1969 | Cheslak et al. . | |
| 3,498,497 | 3/1970 | Baxendale et al. . | |
| 3,508,636 | 4/1970 | Shirley . | |
| 3,512,679 | 5/1970 | Stoltz . | |
| 3,738,487 | 6/1973 | Way et al. | 209/583 X |
| 3,893,589 | 7/1975 | Mandell | 221/123 |
| 4,017,004 | 4/1977 | Onoe et al. | 221/126 X |
| 4,034,839 | 7/1977 | Lee | 194/1 N X |

FOREIGN PATENT DOCUMENTS 712450 6/1965 Canada .

*Primary Examiner*—Joseph J. Rolla
*Attorney, Agent, or Firm*—Kenneth H. Johnson

[57] ABSTRACT

A vending apparatus comprising (1) a storage area comprising a plurality of vertical chutes for storing rectangular boxes or chutes stacked vertically therein, each chute having a fixed ledge at one side of the lower end of the chute and a pivotally mounted ledge opposite to said fixed ledge and biased toward said fixed ledge, for holding and releasing boxes stacked in said chute; (2) a box retrieval mechanism comprising a carriage mounted on a guide and movable below said vertical chutes and in operational association therewith, a motor to drive said carriage, a release member mounted on said carriage for releasing a box from a chute onto said carriage; (3) a delivery area associated with the carriage guide whereby said carriage may approach said delivery area; (4) an arm to move a box from said carriage into said delivery area, and (5) electronic control circuit comprising a detector to sense an empty chute, a circuit arrangement to price each chute individually and alterably, an input to receive currency, a comparator to compare accumulated currency with the price for said chute, a circuit arrangement to select a chute for delivery of a box therefrom and a control arrangement to direct said carriage to the selected chute, operate said release member thereon to drop a box onto said carriage, to direct said carriage to the delivery area and to deliver a box from said carriage into said delivery area.

24 Claims, 10 Drawing Figures

VENDING APPARATUS

BACKGROUND OF THE INVENTION

Field of the Invention

The present invention relates to a vending apparatus comprising a large storage area, an electronic control means and a mechanism to retrieve items from the storage area and delivery to a purchaser. More specifically, the storage area is adapted to store a multiplicity of rectangular boxes in a plurality of racks, such that the retrieval mechanism is directed by the electronic control means to the correct rack to retrieve one box therefrom after payment has been received and recorded by the electronic control. Various aspects of each of three principal components and the manner of cooperation of the three principal components represent novel improvements in vending machines.

The principal utilization of the present apparatus is for the storage and sale of cartons of cigarettes. Notwithstanding the various reports of the United States Surgeon General and various medical organizations on the deleterious effects of cigarette smoking, there has been a continual increase in the number of cigarette smokers. As a consequences, there are now at least 100 brands, which are routinely stocked for sale by major retailers such as grocery stores. The sale of cigarettes is generally essential from a competitive aspect, although profits are generally low. However, inventory control has always presented a problem and the excessive loss of inventory has made cigarette sales even a loss item.

Thus a closed and controlled vending machine can stop much of the pilferage and discourage theft.

2. The Prior Art

U.S. Pat. Nos. 3,508,636, 3,687,255 and 3,791,505 disclose improvements in currency operated vending machines in the use of electronic control systems. Various mechanical storage and retrieval systems have been developed over the years such as U.S. Pat. Nos. 1,191,032, 3,498,497, 3,512,679 and 3,893,589, however, the mechanical and electronic control components of the present invention are an improvement on any heretofore disclosed.

It is an advantage of the present apparatus that it provides a combination of electronic control, electrical mechanical and mechanical elements in a manner to present a secure storage and vending machine with a minimum of malfunctions. It is a feature of the present apparatus that the price of each item for sale from a specific storage rack may be individually adjusted or changed. It is another feature of the present invention that the retrieval mechanism prevents direct access into the storage area from the customer delivery point. It is a further feature of the present apparatus that the retrieval mechanism is controlled by the electronic control thereby not depending on mechanical direction.

SUMMARY OF THE INVENTION

The invention lies in a combination of component elements and in specific improvements in each component element. Thus, one aspect of the present invention is in the combination of (1) a storage area comprising a plurality of vertical chutes for storing rectangular boxes or chutes stacked vertically therein, each chute having a fixed ledge at one side of the lower end of the chute and a pivotally mounted ledge opposite to said fixed ledge and biased toward said fixed ledge, for holding and releasing boxes stacked in said chute; (2) a box retrieval mechanism comprising a carriage mounted on a guide and movable below said vertical chutes and in operational association therewith, means to drive said carriage, release means mounted on said carriage for releasing a box from a chute onto said carriage; (3) a delivery area associated with the carriage guide means whereby said carriage may approach said delivery area; (4) means to move a box from said carriage into said delivery area, and (5) electronic control means comprising means to sense an empty chute, means to price each chute individually and alterably, means to receive currency, means to compare accumulated currency with the price for said chute, means to select a chute for delivery of a box therefrom, and control means to direct said carriage to the selected chute, operate said release means thereon to drop a box onto said carriage, to direct said carriage to the delivery area and to deliver a box from said carriage into said delivery area.

One improvement which may be small in comparison to the overall apparatus is in the selector switches. As will be described later, a matrix based grid system is used for selection identification, for example, in the present illustration eight vertical and eight horizontal terminals are employed giving a total of 64 grid locations. The number of selections can be increased by adjustment of the number of vertical and/or horizontal grid positions. In any event, the actual switch (there are 64 in the present illustration) which would have the name or facsimile of the object in the rack corresponding to the switch is a plate formed of a resilient plastic material which is biased away from the contacts on the grid, however is flexible to hand pressure. A metal contact plate is provided on the side of resilient plastic adjacent to the contacts of the grid, such that depression of the switch makes the necessary contact of the grid to make the product (or vend) selection and upon release of the switch plate it returns to its normal position free of the grid contacts. In other words, a spring which would be a normal element of such a push type switch has been eliminated, the flexible resilient plastic plate serving as both the switch and biasing means to return the switch to off or neutral position.

The switch could comprise a single unit comprising a flexible, resilient, non-conducting member affixed in a first plane and deflectable or depressable out of the first plane, having a metal plate mounted on one side toward a set of electrical contacts, which are aligned with and juxtaposed to said metal plate, said electrical contacts being in a second plane and spaced away from the contact plate but within a distance such that the contact plate will engage the electrical contacts by the deflection or depression of the flexible member toward the electrical contacts.

Furthermore, a multiple switch assembly comprising a sheet or plate of plastic material, i.e., a continuous flexible, resilient, non-conducting member with the individual switches being partially detached sections of the sheet, e.g., square or rectangular sections cut loose on three sides but still joined to the sheet on the fourth side with each switch unit being as described above. Of course, in this arrangement having the individual switch units, i.e., the partially detached sections in a uniform and/or evenly distributed over the sheet or plate. The term "set of electrical contacts" means at least two contacts and any number more which it is desirable to close when the particular switch is depressed. The metal plate is of sufficient size and/or shape to cover the contacts which are to be closed. The metal plate merely completes the circuit by closing the gap between the electrical contact points it contacts and no current or circuit is wired to the metal plate.

Another feature which represents an improvement in one element of the apparatus is the novel box retaining and releasing mechanism at the lower end of each chute. In conjunction with the operation of the release means on the carriage the box in the chute becomes an element of the releasing mechanism.

The carriage itself contains several features which particularly adapt it for trouble free operation for the box retrieval and delivery, which will be apparent from the following description.

The operational center of the apparatus is the electronic control means, which is possibly one of the most advanced ever developed for use in a vending apparatus. The electronic control means performs not only mental steps such as pricing and accumulation of deposits but directs and controls the motor and solenoid operation of the carriage and delivery systems.

These features and others will be clearly seen from the drawing and the detailed discussion of the invention to follow.

DETAILED DESCRIPTION AND PREFERRED EMBODIMENTS

Figure 1:
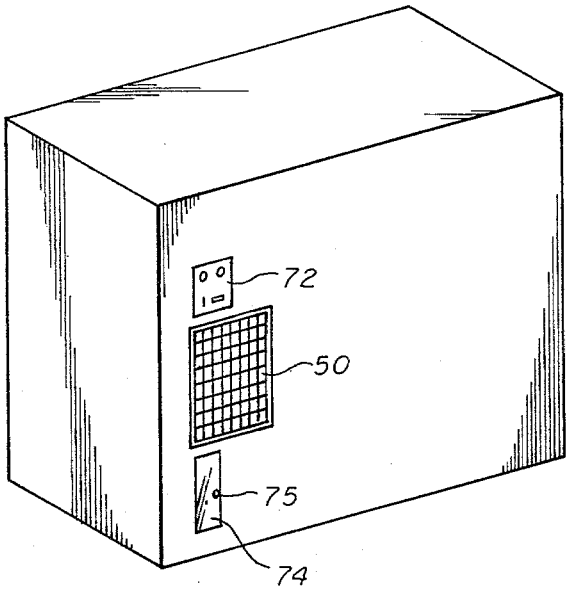
FIG. 1 is a perspective view of a vending apparatus in its use configuration.
Figure 2:
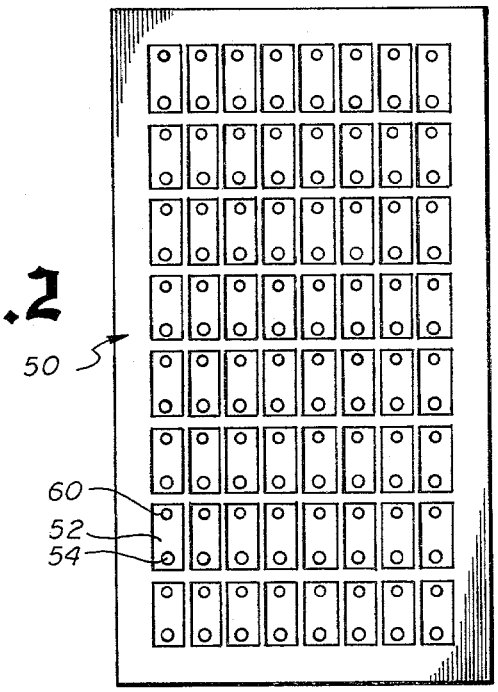
FIG. 2 is a detail view of the selection board of the present apparatus.
Figure 3:
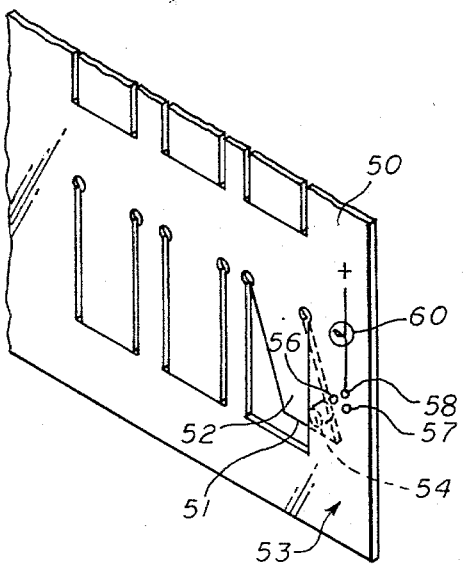
FIG. 3 is a enlarged prospective view of a portion of the selection board of FIG. 2.

The operation of the vending apparatus begins by the operation of the vend select switch. One preferred vend select switch is shown in detail in FIG. 3. In this form, the switch comprises a resilient plastic or other non conducting material which in this embodiment is a rectangular section 52 can be depressed out of the plane of the panel 50. Located toward the free end 51 of section 52 on the inside surface 53 is a contact plate 54 of a conducting metal, which when depressed as shown in FIG. 3 will contact vend contacts 56, 57 and 58.

As will be described hereafter, the connection of the three contacts through plate 54 will either initiate the vend cycle or will be grounded out if the empty switch 13 is closed and light 66 is on. (The light acts as a fuse and no voltage is present at contact 58 when it is burnt out).

It should be appreciated that the switch need not be a cut loose section 52 still attached to a larger panel, however, in this embodiment this is a very convenient method of making multiple switches, inexpensively. Each switch could be a single piece of an appropriate flexible, resilient, non-conducting material mounting to a selector switch panel and the function would be the same. This latter arrangement would allow replacement of one switch, rather than the entire panel if a switch is broken or defective.

Figure 7:
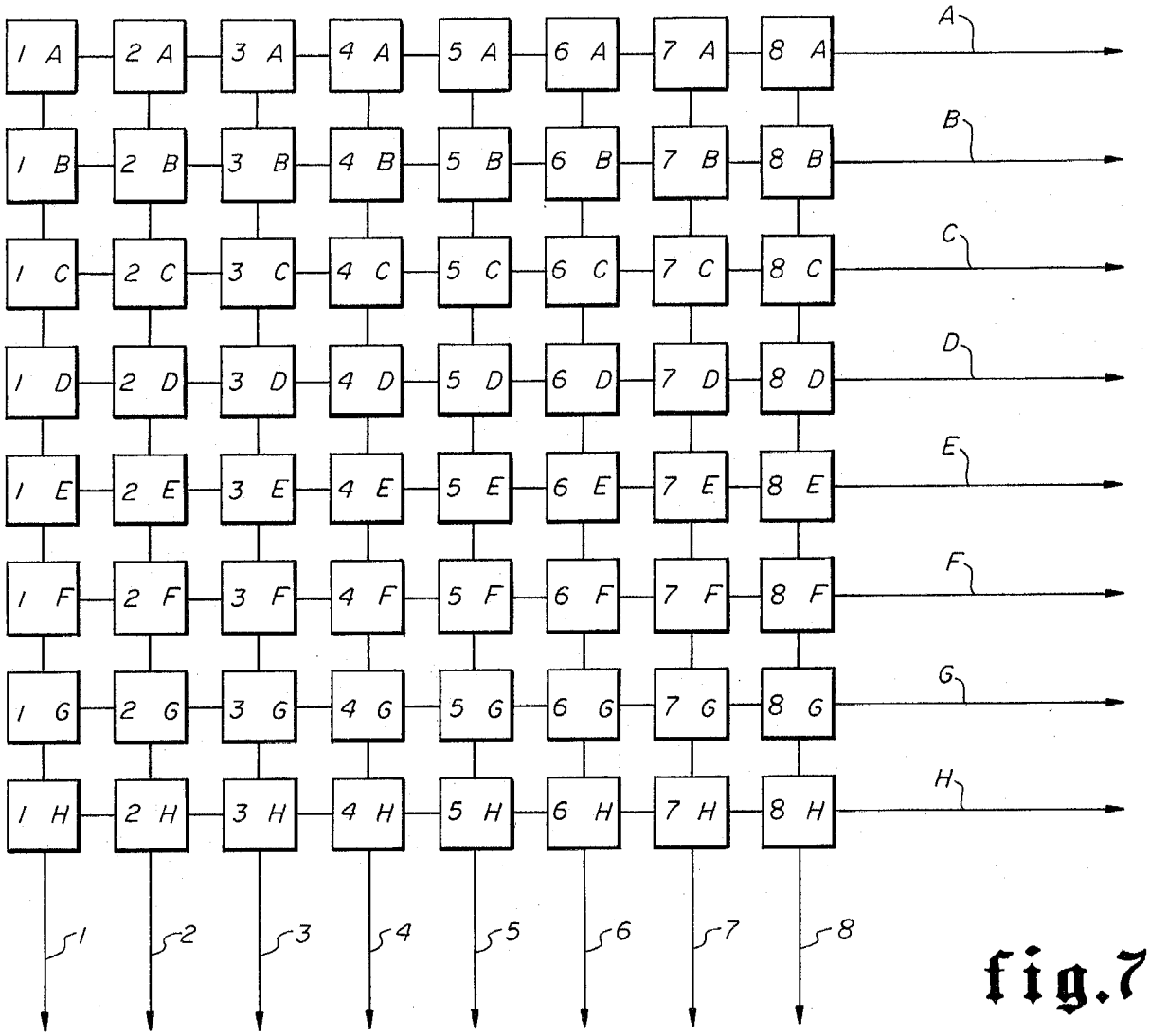
FIG. 7 is a schematic representation of a selector grid.

The operation of the vend select is through a switch matrix. FIG. 7 shows this schematically. In this illustration there are 64 possible selections corresponding to 64 chutes which could each contain a different item, for example, 64 chutes each containing cartons of a brand of cigarette.

The switch matrix is comprised of eight vertical columns and eight horizontal rows. The depression of a vend select switch as described above completes the contacts and a signal is transmitted from there as will be described shortly. As can be seen, the switch matrix forms a grid. When vend select switch is depressed, for example, the third switch from the left in the third row down which is designated 3C (the rows are designated with letters A–H and the columns with numbers 1–8) a signal corresponds to 3C is directed through line C and line 3, thereby providing an "address" which corresponds to a chute in the storage rack section of the apparatus.

Figure 8:
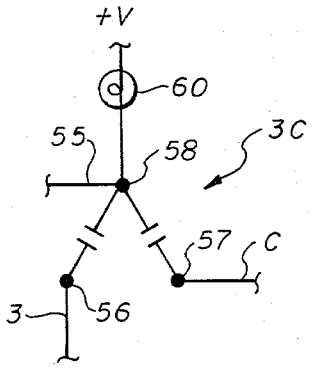
FIG. 8 is a detail of the circuit of one selector button of the present invention.

In regard to the depression of the switch (section 52, FIG. 3) the contacts as shown in FIG. 8 are made. The contact plate 54 connects all three contacts 56, 57 and 58. Contact 58 connects to a switch 13 (FIG. 4) which is depressed and thus open so long as a carton is in the particular rack, however, when the rack is empty the switch 13 is closed and the line 55 is grounded. Thus, when the three contacts 56, 57 and 58 are connected by plate 54, if the rack is empty the light 60 is lit and no signal is sent through lines 59 and 61 and nothing happens. If however, the rack has a carton in it, the closing of the contact between 56, 57 and 58 sends a signal through lines 2 and C into the electronic section to initiate the vend cycle.

Figure 6:
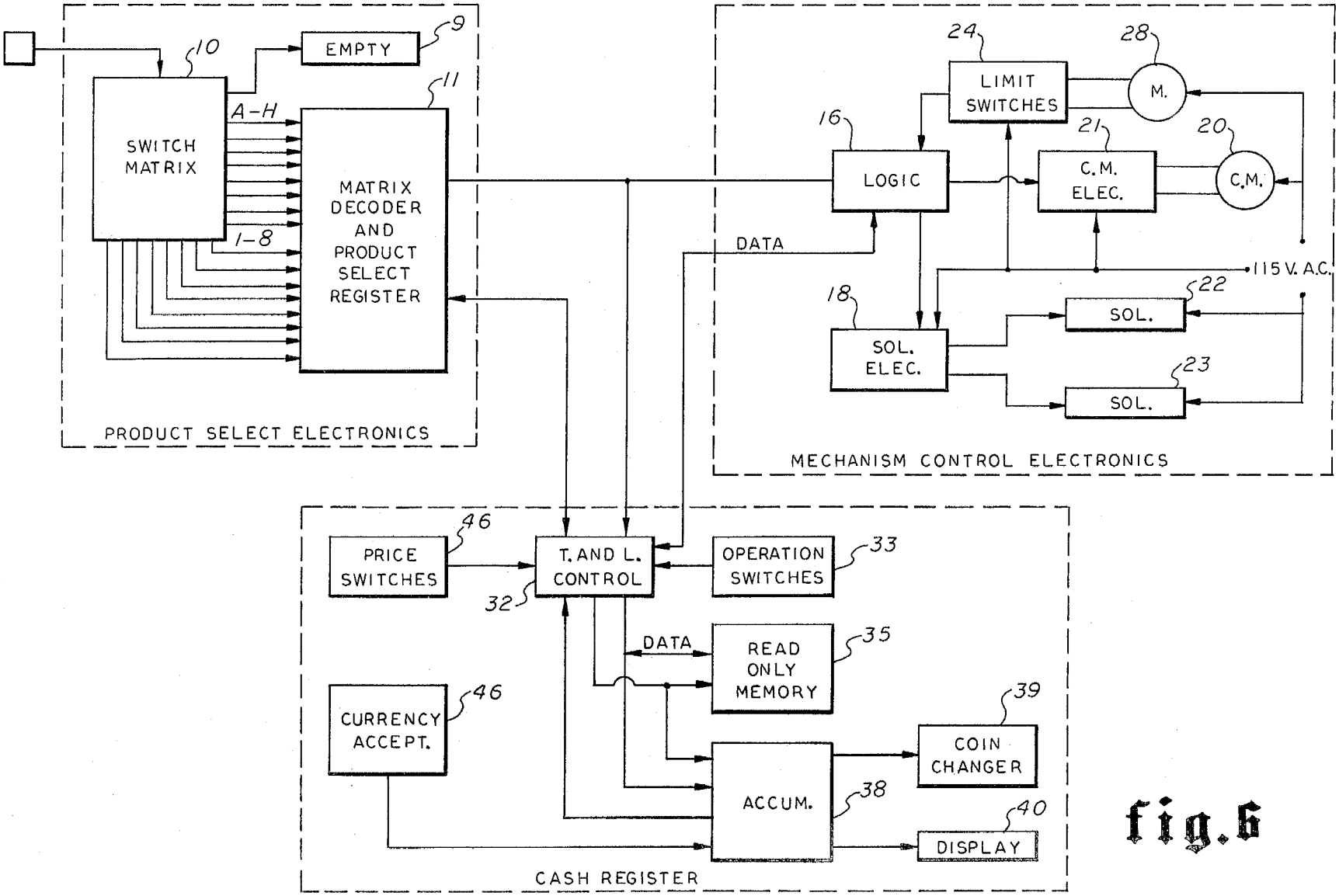
FIG. 6 is a schematic representation of the electronic control means of the present apparatus.

To demonstrate the operation of the apparatus after this first step reference is made to FIG. 6. The switch matrix 10 is connected to a sensing device 13 in each rack. When a chute is empty, a ground circuit is closed to contact 58 as described and no other signal can be transmitted to the matrix decoder 11.

If the chute is not empty when for example, 3C is depressed, a signal is sent via lines 3 and C respectively into matrix decoder and product select register 11. The row 3 and column C, signals are decoded and stored as a binary number in the product select register and a signal is given to the cash register (timing and control logic 32) that a selection has been made.

The price for each rack is entered into electronically alterable read only memory 35 by entering a price on the price entry switches 46 (these are conveniently thumbwheel switches). The operation control switches 33 are automatic/manual, read/write and clear. The price entry is made with the operation control switches 33 in the manual and write position. The desired price is entered on the price entry switches 46 and depressing the desired selector switch, e.g., 3C. The selector switch enters a binary number into the product select register 11 and gives a start signal to the timing and control logic 32, which uses the product select number as the memory address, then reads the price from the price entry switches 46 and stores the price into the memory 35, and into the accumulator 38 which displays the selected price on the numerical display 40. After the price for each chute has been entered in this manner, the operation control switches 33 are changed to automatic and read positions. In the automatic and read position, the machine is ready to vend.

To change a price one would first put the operation control switches 33 into manual/write and repeat the procedure described above.

When the operation control switches are in the automatic and read position, currency may be entered into the currency acceptor 43 to complete the purchase and a desired product (chute) may be selected as described above. The operation control switches are put in the desired mode (manual, automatic, read, write) by an operator. They are put in the automatic/read mode for apparatus use by vend customers.

The entry of currency is performed by placing coin or paper in the appropriate acceptor 43. These devices are conventional and are not inventions of the present inventor. These devices generate a discrete signal, the timing and control logic 32 converts the signal into a binary coded decimal (BCD) number and adds it to the accumulator. The total in the accumulator in the automatic/read mode is displayed on the numerical display 40. Thus, when the price or greater amount posted for the selected product (chute) is reached, the vend select switch can be depressed and a signal transmitted (unless the chute is empty) to initiate retrieval and delivery of the selected product.

When the vend select switch is depressed, a binary number is entered into the product select register 11 which gives a start signal to the timing and control logic 32, which (1) uses the product select number as the memory address, (2) reads the price from the memory 35, and (3) subtracts the price from the accumulator 38. If the price is greater than the amount in the accumulator, nothing will happen. If the price is equal to or less than the amount in the accumulator, a vend signal will be given to the mechanism control electronics (motor and solenoid control logic 16) and the coin changer will give any difference in change (It should be noted that vending machines have by design recently begun not to give change and will accept either exact price or any larger amount with the purchaser forfeiting the difference. The present apparatus can be operated in this fashion, should this trend become the rule.

The operation of Mechanism Control Electronics is initiated by the vend signal from the timing and control logic 32 to the motor and solenoid control logic 16. The product select number is provided to the motor and solenoid control logic 16 gives a signal to the carriage motor 20 to drive the motor away from the delivery area (shown in FIG. 4) toward the storage racks 82 and the selected chute. The carriage position encoder, which consists of elements 94 and 96, 94 being a bar code mounted to the frame (not shown) and 96 being the optical reader (photo) cells and lamp) mounted on the carriage, sends the position of the carriage to the motor and solenoid control logic 16, which compares the reported position with the selected product (chute) position and when they are equal the carriage drive signal is removed and the carriage is stopped at the selected location. The motor and solenoid control logic then operates a solenoid to release a product from the select chute and position it on the carriage as described later in regard to FIGS. 4 and 5. When the solenoids are reset the motor and solenoid control logic 16 reversed power on the carriage motor and returns it and the selected product (now on the carriage) to the delivery area, where the carriage trips a first limit switch 102 thereby signaling the motor and solenoid control logic 16 to stop the carriage. The tripping of the second limit switch 101 initiates a motor 28 which operates an arm 109 (shown in FIG. 4) to push selected product from the carriage to a point where the customer can retrieve it. A third limit switch 104 stops the motor 28.

When both limit switches 101 and 104 have been tripped the motor and solenoid control logic switches on the power to carriage motor 20 to move the carriage toward the racks thereby clearing the second limit switch 101 and shutting off power to the carriage motor 20 and signaling motor 28 to return the arm 109 to its original position where a third limit 103 switch is tripped thereby cutting off power to motor 28.

In order to complete the discussion of the electronics of the apparatus, it should be mentioned that with the timing and control logic in the manual/read mode the prices are read from the memory 35, stored in the accumulator 38 and displaced on the numerical read-out 40 by depressing the desired selector switch. Thus, after servicing the apparatus to put in the prices for each chute as described above, the correctness may be verified in manual/read mode. The Clear mode mentioned earlier clears the accumulator.

The electronics are primarily solid state, hence they are compact and easy to service and maintain. The specific electronic hardware which will perform the functions as described are available from various sources and different specific components could, as recognized by those of skill in the art, be employed to achieve these functions. Similarly, there are numerous motors and solenoids, limit switches, coin acceptors, currency validators, change makers and the like all readily available which will carry out the tasks described.

As can be seen from this description of the apparatus electronic component the entire apparatus is integral with the various components interrelated in a functional manner. Certain aspects of the mechanical portions of the apparatus were necessarily mentioned in discussing the electronics, which will make their means or direction of functioning clearer as described below.

The present invention is directed to the vending of boxes or cartons, however it should be readily appreciated that the electronic control means could be adapted to the operation of other electronic mechanical components to vend other items or to vend services such as washing machines, driers, car washes, drive-in theater admission and the like.

The term "currency" is used in a very broad sense and includes not only legal tender (paper and metal), but also special script or tokens especially adapted for use with present apparatus.

The cabinet 70 housing the electronics and apparatus of the preferred vending apparatus may be quite large with the principal portion being product storage. The electronics are centralized and may conveniently be mounted behind or onto a door which would contain the currency acceptor and coin return and price read-out 72, selector switch panel 50 and the product delivery door 74 and handle 75.

Figures 4, 10:
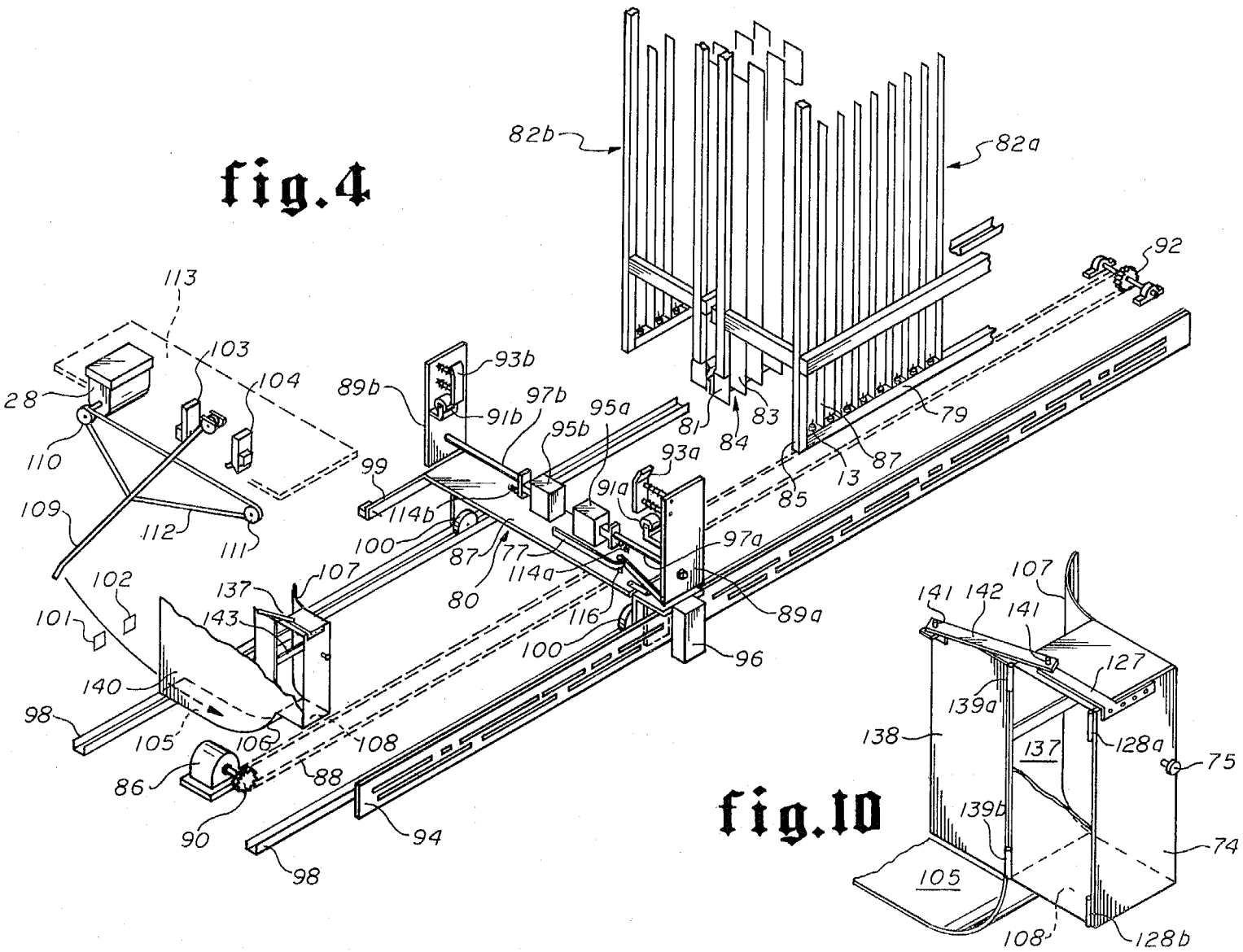
FIG. 4 is a perspective view of the principal mechanical and electro mechanical elements of the present invention and their relationship.
FIG. 10 is a detail of a door arrangement in the delivery area.

The overall operation of the mechanical elements of the vending apparatus can be described from FIG. 4 which illustrates the essential mechanical components. The carriage 80 is mounted onto wheels 100 which are set in slots or rails 98 which are substantially parallel. The carriage is attached (attachment not shown) on its under side to chain drive 88 which is driven by motor 86 about cogs 90 and 92. It has been found that an expensive stepper type motor is not necessary to achieve the degree of exactness necessary for positioning the carriage within the apparatus, and in the present embodiment, a permanent split capacitor motor was employ. The location of the carriage in the apparatus is determined by the electronics through means of sensing device 96 attached to the carriage. The sensing device, for example, a photo electric cell determines the location by means of coded strip 94 which relates the memory "address" of each location in regard to the carriage by the encoded strip. Thus, it is by the use of the code position and the permanent split capacitor motor that the carriage is exactly positioned under a selected portion of the storage racks 82 in order to receive an item, such as a carton of cigarettes from a particular chute in the racks. In order to do this, the carriage is driven just slightly past the "address" of the particular selected chute, then continues the movement back and forth until it is exactly positioned on the selected chute as determined on the control from the electronic section (motor logic) to the motor 86.

It should be appreciated that alternate methods of encoding the location of a carriage may be employed to the strip as shown in FIG. 4. For example, the information on the strip may be transferred to a rotatable disc which is geared to correspond to a location of a carriage, i.e., may be connected by means not shown here directly to the shaft of the motor 86 such that the photo cell which would then be located adjacent to the rotatable disc reads the location from the rotatable disc and stops the carriage at the appropriate point. Similarly, the encoded message may be presented on the disc or the strip 94 by means of optical readable systems, magnetically readable systems or other electronically readable systems. It suffices to say that the location of the carriage is to be determined by an encoded system of whatever nature which is read and controlled by the electronic system for positioning the carriage.

The rack 82 is composed of a plurality of vertical members in array along the path of movement of the carriage, for example, the first rack 84 is composed of vertical members 81 and 83 at the back side and 85 and 87 at the front side. A carton of cigarettes would extend through the rack and seat on the empty switch 13, which when depressed by the weight of a single box will be open. It will be closed only when the chute is entirely empty, thereby giving the empty signal, i.e., light 60 on selector panel 50.

Figure 5:
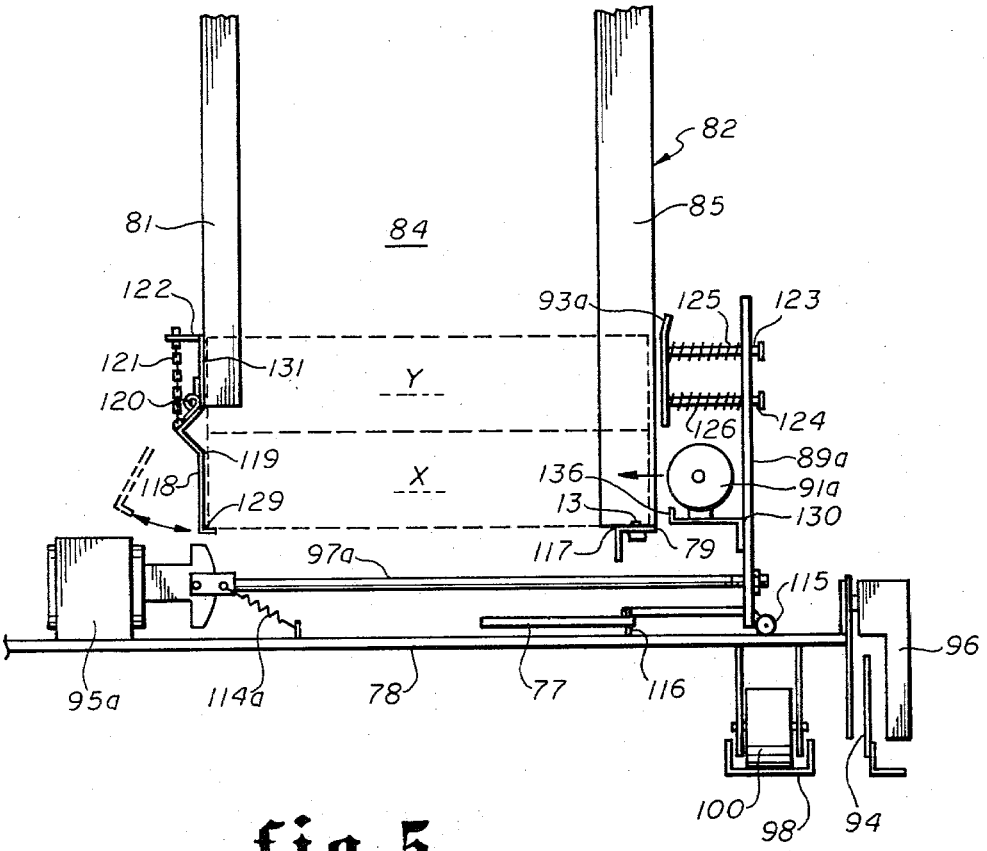
FIG. 5 is a side elevation view of a storage rack and the carriage mechanism of the present apparatus.

The location of cartons in the chutes can be better seen in FIG. 5 where the rail 79 forms a shoulder 117 on which one end of the carton rests thereby depressing the empty switch 13. At the opposite end of the chute 84, the carton rests on lip 129 of the biased rear panel 118.

Referring back to FIG. 4, the carriage as shown, passes under two sets of racks, set back to back. There are in effect two operable sets of mechanisms to release an item from a chute, i.e., either front chute or rear chute onto the carriage. The carriage 80 comprises a platform 78 onto which are mounted solenoids **95*a* and 95*b* which are mounted adjacent to each other near the center of the platform 78 and which are connected by means of a rod 97*a* and 97*b* to an end member 89*a* and 89*b*. On each end member is mounted a roller 91*a* and 91*b* and a biased holding plate 93*a* and 93*b*. The two ends of the carriage are duplicates in function, except that at the forward end of the carriage (a component) there is a push rod pivotally mounted to pin 116 and connected to end plate 89*a***.

The function of this push rod 77 is such that when the solenoid **95*a* is activated the rod 97*a* is drawn inward toward the solenoid thereby rotating the push rod 77 about pin 116 and off of the carriage platform 78. As will be described hereinafter, this action also will cause a carton in the chute under which the carriage is situated to drop from the chute, as a result of the activation of the solenoid 95*a*, onto the platform. At the completion of this part of the vend cycle, the solenoid 95*a* is turned off and push arm 97*a* is returned to its at rest position by spring 114 and at the same time causing push rod 77 to rotate back to the position shown in FIG. 4 and force the carton of cigarettes on the platform toward the b side of the platform of the carriage. This is necessary in this configuration since the delivery from the carriage into the delivery chute 105 and ultimately to the customer is achieved from the back portion (b portion) of the carriage. At the back side of the carriage (b end) extending laterally therefrom toward the delivery area represented by the delivery area represented by the delivery chute 105, is an arm 99 which is used to activate limit switches 101 and 102** in regard to the electronics. This is an expedient and the location of the limit switches could be elsewhere, however, this removes them from the area of the delivery and makes the construction and servicing of the apparatus somewhat easier.

The delivery area is located to the far left of the apparatus and consists principally of the delivery chute 105 which is composed of a bottom portion 106 which extends outward so as to extend over the carriage when the carriage is in its delivery position, and also side member 107 which extends from the area of the carriage to the opening 137. The combination of the side members 107 and 140 and the bottom 106 are to form a funnel like arrangement so that a carton which is seated on the back portion (b portion) of the carriage is aligned with the funnel. As described before in the electronic section, the arrival of the carriage at the delivery position is sensed by limit switches 101 and 102 (switch 102 stops motor 86 and switch 101 reports the arrival of the carriage at the delivery position) which may be optically activated and which thereby signal motor 28 to operate pusher arm 109 through the predetermined path shown by the arrow to come across the platform angularly toward the funnel formed by bottom 106 and side member 107 of the delivery chute 105 toward the opening 137 and to thereby push a carton in its longitudinal direction up the chute and through the opening 137 onto platform 108. Having done this, the pusher arm 109 has reached limit switch 104 thereby signaling that the delivery has been completed. The carriage 80 is then moved slightly away from the delivery area and toward the racks 82 from the position indicated by limit switch 101 thereby signaling the motor 28 to return the pusher arm 109 to its original ready position which when it arrives there trips limit switch 103 thereby cutting off the power to motor 28.

The pivotally mounted pusher arm 109 is moved through its arc by operational motor 28 which moves the belt 112 in the appropriate direction about pulleys 110 and 111. The pusher arm pulleys and motor and sensing devices, limit switches 103 and 104 are all attached to deck 113 shown by the phantom outline.

In so doing, the vend operation is essentially complete in that the product has been selected, obtained from the rack by the carriage, delivered to the delivery area where it has been placed onto platform 108. Referring to FIG. 10, there is one embodiment for the closure to the delivery area which provides a door 74 having a handle 75, the door being hingedly attached to the front panel of cabinet 70 at 128*a* and 128*b*. The door 74 is normally held in locked position by an electronic latch (not shown) which is released upon delivery of the vended carton onto platform 108 either by a weight sensitive switch (not shown) attached to platform 108 or by means of the tripping of limit switch 103 thereby allowing the door to be opened and the customer to retrieve the carton from the compartment formed in the apparatus on platform 108.

The door 74 is located at the front of platform 108 and opposite opening 137. Door 138 is hingedly attached at 139*a* and 139*b* at the edge of opening 137 on side 140. An arm 127 is attached to door 74 and extends toward the opening 137. Extending upward from the arm is a pin 141. Member 142 is pivotally mounted onto pin 141 and extends to pin 143 mounted on door 138 on which member 142 is also pivotally mounted, whereby when door 74 is opened, door 138 is drawn forward about hinges 139*a* and 139*b* by member 142 which pivots about pins 141 and 143, thereby closing the opening 137 and preventing the carton on platform 108 from inadvertently falling down the chute 105 or entry into the machine while the door is open. The door 143 is located about two thirds of the way up in the opening 137 and prevents a carton delivered onto platform 108 from falling back down chute 105. The carton passes below bar 143 on its way to platform 108.

The operation of the release mechanism on the carriage in order to secure a carton from one of the chutes 84 in rack 82 can be readily described in relation to FIG. 5. The cartons, X and Y are shown by the phantom lines stacked into chute 84. Carton X is the bottom carton and rest on the shoulder 117 formed by rail 79 thereby depressing the empty switch 13 and allowing a vend from this particular chute. When the carriage has been exactly positioned so as to receive the carton X onto the carriage (as described above) the electronics then operates solenoid 95*a* which draws rod 97*a* toward the solenoid thereby causing the following sequence of events to occur. The biased holding plate 93*a* passes between vertical members 85 and 87 and contacts carton Y (if there is no carton, then the step is irrelevant) thereby holding any carton Y and those thereabove in place by means of the pressure by the biased plate 93*a* pressing the carton Y against portion 131 of bracket 122. The plate 98*a* is biased by the spiral springs 125 and 126 which surround rods 123 and 124 which are affixedly attached to the holding plate 93*a* and are situated through holes (not shown) in the member 89*a* so that the holding plate 93*a* is biased outwardly toward the rack from the member 89*a*. The use of a biased or pressured holding plate is of course, to prevent damage to the carton in the chute, thus it is readily apparent that the strength of the spring and the tension and biasing force applied must be determined for the particular nature of the objects to be held thereby in the chute. As the end plate 89*a* is pulled forward and the cartons Y and above are held in place, the roller 91*a* mounted to end member 89*a* contacts the carton X and forces carton X in the direction of the arrow. In so doing, the end of carton X adjacent to roller 91*a* is forced off of shoulder 117 thereby freeing that end from downward restraint. Concurrently, the carton, which now functions as a portion of the mechanical element of the apparatus, forces the biased rear panel 118 into the position shown by the phantom line thereby leaving the biased rear panel in contact with the carton X at only a point 119. This slight contact plus the contact with the roller 91*a* allows the weight of a single carton through the pull of gravity to fall onto platform 78. As the end member 89*a* was pulled towards the rack, pusher arm 77 was rotated off of the platform by pivoting about pin 116 and out of the way of the carton allowing the carton to fall directly onto the platform 78. At this point, the cycle of the delivery of the carton from the chute is completed and the solenoid 95*a* is turned off by the electronics and the pusher rod returned to the right of FIG. 5 by means of an internal spring and/or spring 114*a* thereby causing pusher rod 77 to rotate back onto the platform and at the same time to force the carton, as described previously, onto the opposite end of the platform 78 (not fully shown in FIG. 5) ready for delivery into the delivery chute 105.

To facilitate the movement of the end member 89*a*, a small wheel or roller 115 is attached to the end plate adjacent to the platform 78 and rolls along the platform surface.

The biased rear panel 118 is attached to bracket 122 member 81 by means of a spring loaded hinge 120 which tends to force the back panel toward the cartons. The bracket 122 is attached to vertical members 81 and 83. At the lower end of panel 118 is a lip 129 on which the back side of the carton X rests. As the cycle has been completed, and the end member 89*a* withdrawn to the right of FIG. 5, the restraint on carton Y is removed. When carton X fell from the chute on to platform 78, rear panel 118 resumed its at-rest and original position which is limited by chain 121 attached to bracket 122. Allowing carton Y to fall from the position where it is shown into the position previously occupied by carton X where it rests at the rear on lip 129 and at the front on shoulder 117. The carriage 80 is then directed by the electronics to the delivery area and the delivery made as previously described.

Figure 9:
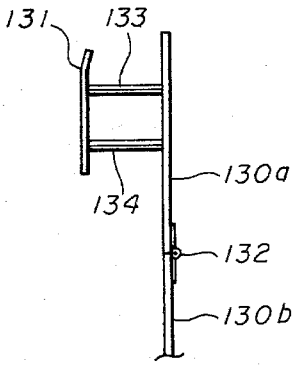
FIG. 9 is an alternative means of one component of the apparatus, in particular the means of releasing an item from storage.

An alternate embodiment or means by which the pressure plate is affixed to the end member is shown in FIG. 9 wherein the end member 130*a* is comprised of a plate attached to a lower plate 130*b* by means of a biased spring which tends to urge the upper end member 130*a* into a vertically aligned position with the lower member 130*b* wherein the holding plate 131 is affixedly attached by means of rods 133 and 134 to the end member 130*a* and the desired resilience when the holding plate contacts the cartons in the chute is obtained through the spring loaded hinge 132.

The invention claimed is:

1. In combination a vending apparatus comprising:

(1) a storage area comprising a plurality of vertical chutes for storing rectangular objects stacked vertically therein, each of said chutes having a fixed ledge at one side of the lower end of the rack and a movable ledge opposite said fixed ledge and biased toward said fixed ledge for holding and releasing said objects stacked in said chute;

(2) an object retrieval mechanism comprising a carriage mounted on a guide and movable below said vertical chutes and in operational association therewith, means to drive said carriage, release means mounted on said carriage for releasing said object from a chute onto said carriage;

(3) a delivery area associated with the carriage guide means whereby said carriage may approach said delivery area, said delivery area comprising a compartment having inwardly and upwardly sloping walls forming a vertical opening at their upward terminus and having a platform extending therefrom;

(4) means to move said object from said carriage into said delivery area comprising a pivotally mounted arm and means to move said arm from a resting position about said pivot to move said object through said compartment and said vertical opening onto said platform, said arm moving in a predetermined path; and (5) electronic control means comprising means to sense an empty chute, means to price each chute individually and alterably, means to receive currency, means to compare accumulated currency with the price for said chute, means to select a chute for delivery of a object therefrom onto said carriage, and carriage control means to direct said carriage to the selected chute, to operate said release means on said carriage to drop an object from the selected chute onto said carriage, to direct said carriage to the delivery area and to deliver an object from said carriage into said delivery area.

2. The vending apparatus according to claim 1 wherein said chutes are formed by a plurality of vertical members in array along the path of movement of said carriage.

3. The vending apparatus according to claim 2 wherein said carriage comprises a platform having a movably mounted vertical end member thereon, means on said platform to pull said end member a predetermined distance onto said platform, a biased holding plate extending from said end member inwardly over said platform and a pushing member mounted below said holding plate and extending inwardly over said platform, said holding plate and pushing member being sized to pass between adjacent vertical members forming said chutes, said vertical end member, holding plate and pushing member being positionable on said platform to pass along the outside of said chutes.

4. In combination a vending apparatus comprising:

(1) a storage area comprising a plurality of vertical chutes for storing rectangular objects stacked vertically therein each of said chutes having a fixed ledge at one side of the lower end of the rack and a movable ledge opposite said fixed ledge and biased toward said fixed ledge, for holding and releasing said objects stacked in said chute;

(2) an object retrieval mechanism comprising a carriage mounted on a guide and movable (a) below said vertical chutes, said chutes being formed by a plurality of vertical members in array along the path of movement of said carriage, said carriage comprising a platform having a movably mounted vertical end member thereon, means on said platform to pull said end member a predetermined distance onto said platform, a biased holding plate extending from said end member inwardly over said platform and a pushing member mounted below said holding plate and extending inwardly over said platform, said holding plate and pushing member being sized to pass between adjacent vertical members forming said chutes, said vertical end member, holding plate and pushing member being positionable on said platform to pass along the outside of said chutes, and (b) in operational association with said chutes, means to drive said carriage, release means mounted on said carriage for releasing said object from a chute onto said carriage;

(3) a delivery area associated with the carriage guide means whereby said carriage may approach said delivery area;

(4) means to move said object from said carriage into said delivery area and;

(5) electronic control means comprising means to sense an empty chute, means to price each chute individually and alterably, means to receive currency, means to compare accumulated currency with the price for said chute, means to select a chute for delivery of an object therefrom onto said carriage, and carriage control means to direct said carriage to the selected chute, to operate said release means on said carriage to drop an object from the selected chute onto said carriage, to direct said carriage to the delivery area and to deliver an object from said carriage into said delivery area.

5. The vending apparatus according to claim 4 wherein pushing member is a roller.

6. The vending apparatus according to claim 4 wherein said biased holding plate is fixedly attached to a member movably mounted through said vertical end plate and biased away therefrom.

7. The vending apparatus according to claim 4 wherein said biased holding plate is fixedly attached to a member which is fixedly attached to said vertical end member, said vertical end member being comprised of two plates hinged together and biased into vertical configuration.

8. The vending apparatus according to claim 4 wherein said vertical end member is mounted on a roller contacting said platform.

9. The vending apparatus according to claim 4 wherein said means to pull is a solenoid.

10. The vending apparatus according to claim 1 or 4 wherein said guide for said carriage comprises a pair of slotted rails in which wheels mounted to said carriage are rollably mounted.

11. The vending apparatus according to claim 10 wherein said rails are substantially parallel.

12. The vending apparatus according to claim 10 wherein said carriage is moved along said rails by a motor driven chain.

13. The vending apparatus according to claim 12 wherein said motor is a permanent split capacitor motor.

14. The vending apparatus according to claim 4 wherein said delivery area comprises a compartment having inwardly and upwardly sloping walls forming a vertical opening at their upward terminus and having a platform extending therefrom.

15. The vending apparatus according to claim 14 wherein said means to move said object comprises a pivotally mounted arm and means to move said arm from a resting position about said pivot to move said object through said compartment and said vertical opening onto said platform, said arm moving in predetermined path.

16. The vending apparatus according to claim 14 or 1 having sensing means to determine when said carriage is in said delivery area to operate said means to move said object.

17. The vending apparatus according to claim 16 having sensing means to determine when said arm has completed said predetermined path and to direct said arm back to said resting position.

18. The vending apparatus according to claim 1 or 4 wherein a sensing means is located in each chute for determining if the chute is empty.

19. The vending apparatus according to claim 18 wherein the sensing means is located on the fixed ledge.

20. The vending apparatus according to claim 1 or 4 wherein said electronic control means comprises:

(a) a switch matrix, having a plurality of switches each of said switches being associated with two points in a grid in said matrix, for selecting an object from a plurality of objects, (b) a matrix decoder and object select register electronically connected to said switch matrix, for receiving a grid location signal from said matrix for a selected object and decoding the signal to instruct an object recovery means electronic control of the location of said object in the vending apparatus and to instruct a cash register electronically of the object selection, (c) the cash register comprising a currency acceptor to receive currency electronically connected to an accumulator to record received currency, an electronically alterable read only memory electronically connected to said accumulator whereby said accumulator compares the price of the selected object with the currency received such that when the currency received is equal to or greater than the price in said memory, said accumulator emits an electronic signal, and (d) a timing and logic control which receives said signal from said accumulator and electronically instructs a mechanism control logic to vend the selected object, whereby the mechanism control logic directs the object retrieval means to the location decoded by the matrix decoder in the apparatus and operates said object retrieval mechanism to recover the selected object and deliver it.

21. The vending apparatus according to claim 1 or 4 wherein means is provided to encode the location of carriage for transmitting said location to said carriage control means.

22. The vending apparatus according to claim 21 wherein said means to encode the location of said carriage comprises an encoded strip.

23. The vending apparatus according to claim 22 wherein said encoded strip is located along the path of said carriage and means is located on said carriage to sense said code.

24. In combination a vending apparatus comprising:

(1) a storage area comprising a plurality of vertical chutes for storing rectangular objects stacked vertically therein, each of said chutes having a fixed ledge at one side of the lower end of the rack and a movable ledge opposite said fixed ledge and biased toward said fixed ledge, for holding and releasing said objects stacked in said chute;

(2) an object retrieval mechanism comprising a carriage mounted on a guide and movable below said vertical chutes and in operational association therewith, means to drive said carriage, release means mounted on said carriage for releasing said object from a chute onto said carriage;

(3) a delivery area associated with the carriage guide means whereby said carriage may approach said delivery area;

(4) means to move said object from said carriage into said delivery area and;

(5) electronic control means comprising:

(a) a switch matrix having a plurality of switches, each of said switches being associated with two points in a grid in said matrix, for selecting an object from a plurality of objects, (b) a matrix decoder and object select register electronically connected to said switch matrix for receiving a grid location signal from said matrix for a selected object and decoding the signal to instruct an object retrieval means electronic control of the location of said object in the vending apparatus and to instruct a cash register electronically of the object selection, (c) the cash register comprising a currency acceptor to receive currency electronically connected to an accumulator to record received currency, an electronically alterable read only memory electronically connected to said accumulator whereby said accumulator compares the price of the selected object with the currency received such that when the currency received is equal to or greater than the price in said memory, said accumulator emits an electronic signal, and (d) a timing and logic control which receives said signal from said accumulator and electronically instructs a mechanism control logic to vend the selected object, whereby the mechanism control logic directs the object retrieval mechanism to the location decoded by the matrix decoder in the apparatus and operates said object retrieval mechanism to recover the selected object and deliver it.

* * * * *